US007919194B2

(12) United States Patent
Kawamura et al.

(10) Patent No.: US 7,919,194 B2
(45) Date of Patent: Apr. 5, 2011

(54) HIGH STRENGTH STEEL SHEET HAVING SUPERIOR DUCTILITY

(75) Inventors: Kenji Kawamura, Fukuyama (JP); Taro Kizu, Chiba (JP); Shusaku Takagi, Fukuyama (JP); Kohei Hasegawa, Fukuyama (JP); Hiroshi Matsuda, Chiba (JP); Akio Kobayashi, Chiba (JP); Yasunobu Nagataki, Chiba (JP); Yasushi Tanaka, Chiba (JP); Thomas Heller, Duisburg (DE); Brigitte Hammer, Voerde (DE); Jian Bian, Moers (DE); Günter Stich, Bochum (DE); Rolf Bode, Wesel (DE); Brigitte Bode, legal representative, Wesel (DE)

(73) Assignees: JFE Steel Corporation (JP); ThyssenKrupp Steel AG (DE)

( * ) Notice: Subject to any disclaimer, the term of this patent is extended or adjusted under 35 U.S.C. 154(b) by 109 days.

(21) Appl. No.: 12/372,836

(22) Filed: Feb. 18, 2009

(65) Prior Publication Data

US 2009/0214892 A1 Aug. 27, 2009

(30) Foreign Application Priority Data

Feb. 19, 2008 (JP) ..... 2008-036870

(51) Int. Cl.

| | |
|---|---|
| ***B32B 15/04*** | (2006.01) |
| ***B32B 15/18*** | (2006.01) |
| ***B32B 15/20*** | (2006.01) |
| ***C22C 38/18*** | (2006.01) |

(52) U.S. Cl. ..... 428/659; 428/684; 148/333; 148/334; 148/335

(58) Field of Classification Search ..... 428/658, 428/659, 681, 682, 684
See application file for complete search history.

(56) References Cited

U.S. PATENT DOCUMENTS

2008/0000555 A1* 1/2008 Nonaka et al. ..... 148/328

FOREIGN PATENT DOCUMENTS

| | | | |
|---|---|---|---|
| EP | 1 431 406 | | 6/2004 |
| EP | 1 642 990 | | 4/2006 |
| EP | 1 808 505 | | 7/2007 |
| EP | 1 889 935 | | 2/2008 |
| JP | 61-157625 | A | 7/1986 |
| JP | 05-247586 | A | 9/1993 |
| JP | 10-130776 | A | 5/1998 |
| JP | 11-279691 | A | 10/1999 |
| JP | 2000-345288 | A | 12/2000 |
| JP | 2004292891 | | 10/2004 |
| JP | 2005-008961 | A | 1/2005 |
| JP | 2005-220430 | * | 8/2005 |
| JP | 2005-220430 | A | 8/2005 |
| JP | 2005-298964 | * | 10/2005 |
| JP | 2008-291304 | * | 12/2008 |

OTHER PUBLICATIONS

Machine Translation, Fujita et al., JP 2005-298964, Oct. 2005.*
Machine Translation, Iwama et al, JP 2005-220430, Aug. 2005.*
Machine Translation, Nakagaito et al., JP 2008-291304, Dec. 2008.*

* cited by examiner

*Primary Examiner* — Michael La Villa
(74) *Attorney, Agent, or Firm* — DLA Piper LLP (US)

(57) ABSTRACT

A high strength steel sheet and a method for manufacturing the same has superior phosphatability properties and hot-dip galvannealed properties besides a tensile strength of 950 MPa or more and a high ductility, and also having a small variation in mechanical properties with the change in annealing conditions.

10 Claims, No Drawings

HIGH STRENGTH STEEL SHEET HAVING SUPERIOR DUCTILITY

RELATED APPLICATION

This application claims priority of Japanese Patent Application No. 2008-036870, filed Feb. 19, 2008, herein incorporated by reference.

TECHNICAL FIELD

This disclosure relates to a high strength steel sheet and a method for manufacturing the same, the high strength steel sheet having a high strength and a superior formability (ductility) to be suitably used primarily for automobile bodies, in particular, for automobile structural members; superior phosphatability and Zn coatability; a small variation in mechanical properties with the change in conditions of annealing performed in manufacturing; and a tensile strength of 950 MPa or more. In this case, the above "small variation in mechanical properties with the change in conditions of annealing" indicates that the difference ΔTS between the maximum and the minimum tensile strengths in a soaking temperature range of 780 to 860° C. in an annealing step is 100 MPa or less.

BACKGROUND

In recent years, in view of global environment conservation, an improvement in fuel efficiency of automobiles has been strongly requested. Accordingly, by increasing the strength of materials used for forming automobile bodies, a decrease in thickness and a reduction in weight have been energetically carried out. However, the increase in strength of steel sheets may cause degradation in formability due to degradation in ductility and, hence, development of materials having a high strength and a high ductility at the same time has been desired.

Heretofore, as a material in response to the requirement as described above, composite microstructure steel sheets, such as transformation hardening type DP steel (Dual Phase Steel) composed of ferrite and martensite, and TRIP steel using the TRIP (Transformation Induced Plasticity) phenomenon of retained austenite, have been developed.

For example, in Japanese Unexamined Patent Application Publication Nos. 61-157625 and 10-130776, TRIP steel using strain-induced transformation of retained austenite has been disclosed. However, since this TRIP steel needs an addition of a large amount of Si, there has been a problem in that phosphatability and/or hot-dip galvannealed properties of steel sheet surfaces are degraded, and in addition, since an addition of a large amount of C is required to increase the strength, for example, there has also been a problem in that a nugget fracture at a spot-welded joint is liable to occur.

In addition, in Japanese Unexamined Patent Application Publication No. 11-279691, a hot-dip galvannealed steel sheet having superior formability has been disclosed which achieves a high ductility by securing retained γ by an addition of a large amount of Si. However, since Si causes degradation in Zn coatability, when Zn coating is performed on the steel as described above, a complicated step, such as pre-coating of Ni, application of a specific chemical, or reduction of an oxide layer on a steel surface to control the oxide layer thickness, must be performed.

In addition, in Japanese Unexamined. Patent Application Publication Nos. 05-247586 and 2000-345288, TRIP steel containing a reduced amount of Si has been disclosed. However, since this TRIP steel needs an addition of a large amount of C to ensure a high strength, a problem relating to welding has still remained and, in addition, since the yield stress is extremely increased at a tensile strength of 980 MPa or more, there has been a problem in that dimensional precision in sheet metal stamping are degraded.

Furthermore, in general, in the TRIP steel, since a large amount of retained austenite is present, at the interface between a martensite phase generated by the induced transformation in forming and a phase therearound, a large number of voids and dislocations are generated. Hence, it has been pointed out that at the place as described above, hydrogen is accumulated, and as a result, a delayed fracture is disadvantageously liable to occur.

On the other hand, although transformation hardening type DP steel composed of ferrite and martensite has been known as a steel sheet having a low yield stress and a superior ductility, to realize a high strength and a high ductility, an addition of a large amount of Si is required, and as a result, a problem of degradation in phosphatability and/or hot-dip galvannealed properties has occurred. Accordingly, in Japanese Unexamined Patent Application Publication Nos. 2005-220430 and 2005-008961, to ensure hot-dip galvannealed properties, a steel sheet has been disclosed in which the amount of Si is decreased and Al is added. However, it cannot be said that a sufficient ductility is realized.

As described above, by the conventional DP steel and TRIP steel, a high strength cold-rolled steel sheet simultaneously having a high strength and a high ductility, and also having superior phosphatability, Zn coatability and the like has not yet been realized. In addition, in the steel sheets described above, the variation in mechanical properties, in particular, the variation in tensile strength, is large when conditions of annealing performed in manufacturing are changed. Hence, there has been a problem in that manufacturing stability is not good enough.

Accordingly, it could be helpful to solve the above problems of the conventional techniques and provide a high strength steel sheet and a method for manufacturing the same, the high strength steel sheet having a tensile strength of 950 MPa or more and a high ductility; superior phosphatability and hot-dip galvannealed properties; and a small variation in mechanical properties with the change in conditions of annealing.

SUMMARY

We found that a cold-rolled steel sheet which is composed of a microstructure including ferrite and martensite as primary components, which has a high strength and a high ductility, and which also has superior phosphatability and Zn coatability can be stably obtained when the variation in mechanical properties with the change in soaking temperature in an annealing step is decreased by control of the component composition of steel in an appropriate range, that is, in particular, by an increase in intercritical temperature region of ferrite and austenite by addition of an appropriate amount of Al and, furthermore, when the variation in mechanical properties with the change in conditions of cooling performed after the annealing is decreased by addition of appropriate amounts of Cr, Mo, and B to enhance quenching properties of austenite which is generated in the annealing.

We thus provide a high strength steel sheet comprising a component composition which includes 0.05 to 0.20 mass percent of C, 0.5 mass percent or less of Si, 1.5 to 3.0 mass percent of Mn, 0.06 mass percent or less of P, 0.01 mass percent or less of S, 0.3 to 1.5 mass percent of Al, 0.02 mass percent or less of N, 0.01 to 0.1 mass percent of Ti, and 0.0005 to 0.0030 mass percent of B; at least one of 0.1 to 1.5 mass percent of Cr and 0.01 to 2.0 mass percent of Mo; and the balance being Fe and inevitable impurities, and the high strength steel sheet described above is composed of a microstructure including ferrite and martensite and has a tensile strength of 950 MPa or more.

The high strength steel sheet may further comprise at least one of 0.01 to 0.1 mass percent of Nb and 0.01 to 0.12 mass percent of V, and/or at least one of Cu and Ni in a total content of 0.01 to 4.0 mass percent.

In addition, the microstructure of the high strength steel sheet may include 20% to 70% of ferrite and 20% or more of martensite in volume fraction, or may further include less than 10% of retained austenite in volume fraction.

In addition, the high strength steel sheet may be provided with a hot-dip galvanizing layer or a hot-dip galvannealed layer thereon.

In addition, we provide a method for manufacturing a high strength steel sheet, which comprises the steps of: hot-rolling a slab having the component composition described above, followed by cold-rolling; then performing annealing at a temperature of 780 to 900° C. for 300 seconds or less; and then performing cooling to a temperature of 500° C. or less at an average cooling rate of 5° C./second or more.

In the method for manufacturing a high strength steel sheet, hot-dip galvanizing may be performed on a surface of the steel sheet after the annealing step, or an alloying treatment may then be further performed.

Since the high strength steel sheet has superior ductility in spite of its high strength, this steel sheet can be preferably used for automobile structural components which are required to have both excellent formability and high strength. In addition, since being also superior in terms of phosphatability, hot-dip galvanized properties, and alloying treatment properties, the high strength steel sheet is also preferably used, for example, for automobile suspension and chassis parts, home electric appliances, and electric components which are required to have excellent corrosion resistance.

DETAILED DESCRIPTION

First, reasons for selecting the component composition of the high strength steel sheet will be described.

C: 0.05 to 0.20 Mass Percent by Weight

C is an essential component to secure an appropriate amount of martensite and to obtain high strength. When the amount of C is less than 0.05 mass percent, it becomes difficult to obtain a desired steel-sheet strength. On the other hand, when the content of C is more than 0.20 mass percent, a welded portion and a heat affected area are considerably hardened. Hence, the weldability is degraded. Hence, the content of C is set in the range of 0.05 to 0.20 mass percent. In addition, to stably obtain a tensile strength of 950 MPa or more, the content of C is preferably set to 0.085 mass percent or more and, mote preferably, 0.10 mass percent or more.

Si: 0.5 Mass Percent or Less

Si is an effective component to increase strength without degrading ductility. However, when the content of Si is more than 0.5 mass percent, bare spots are generated in a hot-dip galvanized steel sheet and/or an alloying reaction which is to be subsequently performed is suppressed. Hence, as a result, degradation in surface quality and/or degradation in corrosion resistance may occur, or in the case of a cold-rolled steel sheet, degradation in phosphatability may occur in some cases. Accordingly, the content of Si is set to 0.5 mass percent or less. In addition, in the case in which hot-dip galvannealed properties are significantly important, the content of Si is preferably set to 0.3 mass percent or less.

Mn: 1.5 to 3.0 Mass Percent

Mn is an element which is not only effective in solid solution strengthening of steel, but also effective in improving quenching. When the content of Mn is less than 1.5 mass percent, a desired high strength cannot be obtained and, in addition, since pearlite is formed during cooling, which is performed after annealing, due to degradation in quenching hardenability, ductility is also degraded. On the other hand, in the case in which the content of Mn is more than 3.0 mass percent, when molten steel is formed into a slab by casting, fractures are liable to occur in slab surfaces and/or corner portions. Furthermore, in a steel sheet obtained by hot-rolling and cold-rolling of a slab, followed by annealing, surface defects are seriously generated. Hence, the content of Mn is set in the range of 1.5 to 3.0 mass percent. In addition, when a rolling load in hot-rolling and cold-rolling is decreased, and the rolling properties are ensured, the content of Mn is preferably 2.5 mass percent or less.

P: 0.06 Mass Percent or Less

P is an impurity which is inevitably contained in steel, and the content of P is preferably decreased to improve formability and coating adhesion. Accordingly, the content of P is set to 0.06 mass percent or less. In addition, the content of P is preferably 0.03 mass percent or less.

S: 0.01 Mass Percent or Less

S is an impurity which is inevitably contained in steel, and the content of S is preferably decreased since S seriously degrades the ductility of steel. Accordingly, the content of S is set to 0.01 mass percent or less. In addition, the content of S is preferably 0.005 mass percent or less.

Al: 0.3 to 1.5 Mass Percent

Al is a component to be added as a deoxidizing agent and is also a component which effectively improves the ductility. In addition, by increasing the intercritical temperature region of ferrite and austenite, Al has the effect of decreasing the variation in mechanical properties with the change in soaking temperature in an annealing step. 0.3 mass percent or more of Al must be added to obtain the above effect. On the other hand, when Al is excessively present in steel, the surface quality of steel sheets after hot-dip galvanizing is degraded. However, when the content is 1.5 mass percent or less, superior surface quality can be maintained. Hence, the content of Al is set in the range of 0.3 to 1.5 mass percent. The content of Al is preferably in the range of 0.3 to 1.2 mass percent.

N: 0.02 Mass Percent or Less

N is an element which is inevitably contained in steel, and when a large amount thereof is contained, besides degradation of mechanical properties by aging, the addition effect of Al is also degraded since the precipitation amount of AlN is increased. In addition, the amount of Ti necessary for fixing N in the form of TiN is also increased. Hence, the upper limit of the content of N is set to 0.02 mass percent. In addition, the content of N is preferably 0.005 mass percent or less.

Ti: 0.01 to 0.1 Mass Percent

Ti fixes N in the form of TiN and suppresses the generation of AlN which causes slab surface fractures in casting. This effect can be obtained by addition of Ti in an amount of 0.01 mass percent or more. However, when the amount of addition is more than 0.1 mass percent, the ductility after annealing is seriously degraded. Hence, the content of Ti is set in the range of 0.01 to 0.1 mass percent. In addition, the content of Ti is preferably in the range of 0.01 to 0.05 mass percent.

B: 0.0005 to 0.0030 Mass Percent

B suppresses the transformation from austenite to ferrite during cooling performed after annealing and facilitates generation of hard martensite. Hence, B contributes to an increase in strength of steel sheets. The effect described above can be obtained by addition of B in an amount of 0.0005 mass percent or more. However, by an addition of B in an amount of more than 0.0030 mass percent, the effect of improving quenching hardenability is saturated, and in addition, by the formation of B oxides on steel sheet surfaces, the phosphatability and the hot-dip galvannealed properties are also degraded. Hence, B in an amount of 0.0005 to 0.0030 mass percent is added. The content of B is preferably in the range of 0.0007 to 0.0020 mass percent.

Cr: 0.1 to 1.5 Mass Percent, and Mo: 0.01 to 2.0 Mass Percent

Cr and Mo shift a ferrite-pearlite transformation nose in cooling performed after annealing to the long-time side and facilitate generation of martensite. Hence, they are effective elements to improve quenching hardenability and increase strength. At least one of 0.1 mass percent or more of Cr and 0.01 mass percent or more of Mo must be added to obtain the above effect. On the other hand, when Cr is more than 1.5 mass percent or Mo is more than 2.0 mass percent, since a stable carbide is generated, quenching hardenability is degraded and, in addition, the alloying cost is also increased. Hence, at least one of 0.1 to 1.5 mass percent of Cr and 0.01 to 2.0 mass percent of Mo is added. Furthermore, for the purpose of achieving a TS×El more than 18,000 MPa·%, the content of Cr is preferably set to 0.4 mass percent or more. In addition, when a hot-dip galvanizing treatment is performed, a Cr oxide formed from Cr may be generated on surfaces and may induce bare spot. Hence, the content of Cr is preferably set to 1.0 mass percent or less. In addition, Mo may degrade the phosphatability of a cold-rolled steel sheet, or an excess addition of Mo may cause an increase in alloying cost. Hence, the content is preferably set to 0.5 mass percent or less.

Besides the above components, whenever desired, the following components may also be added to the high strength steel sheet.

Nb: 0.01 to 0.1 Mass Percent

Nb forms a fine carbonitride and has the effect of suppressing grain growth of recrystallized ferrite and increasing the number of austenite nuclear generation sites in annealing. Hence, the ductility of steel sheets after annealing can be improved. The content of Nb is preferably set to 0.01 mass or more to obtain the effects described. On the other hand, when the content is more than 0.1 mass percent, a large amount of carbonitride is precipitated, and the ductility is conversely degraded. Furthermore, since a rolling load in hot rolling and cold rolling is increased, a rolling efficiency may be degraded, and/or an increase in alloying cost may occur. Hence, when Nb is added, the content thereof is preferably set in the range of 0.01 to 0.1 mass percent. In addition, the content is more preferably in the range of 0.01 to 0.08 mass percent.

V: 0.01 to 0.12 Mass Percent

V has the effect of improving quenching hardenability. This effect can be obtained when 0.01 mass percent or more of V is added. However, when the content thereof is more than 0.12 mass percent, this effect is saturated and, in addition, the alloying cost is increased. Hence, when V is added, the content thereof is preferably set in the range of 0.01 to 0.12 mass percent. In addition, the content is more preferably in the range of 0.01 to 0.10 mass percent.

At Least One of Cu and Ni: The Total Content being 0.01 to 4.0 Mass Percent

Cu and Ni have a strength improving effect by solid solution strengthening and, to strengthen steel, at least one of Cu and Ni in a total content of 0.01 mass percent or more can be added. However, when the content of Cu and Ni is more than 4.0 mass percent, the ductility and the surface quality are seriously degraded. Hence, when Cu and Ni are added, the total content of at least one of the above two elements is preferably set in the range of 0.01 to 4.0 mass percent.

In the high strength steel sheet, the balance other than the components described above includes Fe and inevitable impurities. However, as long as the effects of the steel sheet are not adversely influenced, any component other than those described above may also be contained.

Next, the microstructure of the high strength steel sheet will be described.

To achieve a tensile strength of 950 MPa or more and a high ductility, the microstructure of the high strength steel sheet must be composed of ferrite and martensite, each having a volume fraction described below, as a primary phase and retained austenite as the balance. In this case, the above ferrite indicates polygonal ferrite and bainitic ferrite.

Fraction of Ferrite: 20% to 70% in Volume Fraction

The fraction of ferrite is preferably set to 20% or more in volume fraction to ensure the ductility. In addition, the fraction of ferrite is preferably set to 70% or less in volume fraction. Hence, the fraction of ferrite of the high strength steel sheet is preferably set in the range of 20% to 70%.

Fraction of Martensite: 20% or More in Volume Fraction

The fraction of martensite is preferably set to 20% or more in volume fraction to obtain a tensile strength of 950 MPa or more and is more preferably set to 30% or more. In addition, the upper limit of the fraction of martensite is not particularly specified. However, the fraction is preferably less than 70% to ensure a high ductility.

Fraction of Retained Austenite: Less than 10% in Volume Fraction

When austenite (γ) is retained in the steel sheet microstructure, since secondary working embrittlement and delayed fracture are liable to occur, the fraction of retained austenite is preferably decreased as little as possible. When the fraction of retained γ is less than 10% in volume fraction, an adverse influence thereof is not significant, and the above fraction is in a permissible range. The content is preferably 7% or less and is more preferably 4% or less.

Next, a method for manufacturing the high strength steel sheet will be described.

The high strength steel sheet may be formed by the steps of melting steel having the above-described component composition by a commonly known method using a converter, an electric arc furnace, or the like, performing continuous casting to form a steel slab, and then immediately performing hot rolling, or after the slab is once cooled to approximately room temperature, performing reheating, followed by hot rolling.

The finish rolling temperature of the hot rolling is set to 800° C. or more. When the finish rolling temperature is less than 800° C., besides an increase in rolling load, the steel sheet microstructure becomes a dual phase microstructure at the final rolling stage, and serious coarsening of ferrite grains occurs. The coarsened grains are not totally removed by subsequent cold rolling and annealing. Hence, a steel sheet having good formability may not be obtained in some cases. In addition, the coiling temperature after the hot rolling is preferably set in the range of 400 to 700° C. to ensure a load in cold rolling and pickling properties.

Next, after scale formed on surfaces of the hot rolled steel sheet is preferably removed by pickling or the like, cold rolling is performed to obtain a steel sheet having a desired thickness. In this step, the cold rolling reduction is preferably set to 40% or more. When the cold rolling reduction is less than 40%, since strain introduced in the steel sheet after cold rolling is small, the grain diameter of recrystallized ferrite after annealing is excessively increased and, as a result, ductility is degraded.

The steel sheet after cold rolling is processed by annealing to obtain desired strength and ductility, that is, to obtain superior strength and ductility balance. This annealing must be performed by holding the steel sheet at a soaking temperature in the range of 780 to 900° C. for 300 seconds or less, and then performing cooling to a temperature of 500° C. or less at an average cooling rate of 5° C./second or more. In this case, to cause martensite transformation, the soaking temperature must be set to the temperature or more for the intercritical region of austenite and ferrite. However, to increase the fraction of austenite and facilitate enrichment of C into austenite, the soaking temperature must be set to 780° C. or more. On the other hand, when the soaking temperature is more than 900° C., the grain diameter of austenite is seriously coarsened, and the ductility of the steel sheet after annealing is degraded. Hence, the soaking temperature is set in the range of 780 to 900° C. The soaking temperature is preferably in the range of 780 to 860° C. to achieve a TS×El more than 18,000.

The high strength steel sheet is characterized in that even when the soaking temperature in annealing is changed, the variation in mechanical properties is small. The reason for this is that since the content of Al is high, the temperature range of the intercritical region of austenite and ferrite is increased and, as a result, even when the soaking temperature is considerably changed, the change in steel sheet microstructure after annealing is small. Hence, the change in mechanical properties (in particular, tensile strength) after annealing can be suppressed. As a result, even when the soaking temperature is changed in the range of 780 to 860° C., the change ΔTS (difference between the maximum and the minimum values) in tensile strength of an obtained steel sheet is decreased to 100 MPa or less. Hence, the high strength steel sheet has a significantly superior manufacturing stability.

Cooling from the soaking temperature in the annealing is important to generate a martensite phase, and the average cooling rate from the soaking temperature to 500° C. or less must be set to 5° C./second or more. When the average cooling rate is less than 5° C./second, pearlite is generated from austenite. Hence, high ductility cannot be obtained. The average cooling rate is preferably 10° C./second or more. In addition, when a cooling stop temperature is more than 500° C., cementite and/or pearlite are generated and, as a result, a high ductility cannot be obtained.

After the annealing and cooling are performed in accordance with the conditions described above, the high strength steel sheet may be formed into a hot-dip galvanized steel sheet (GI) by performing hot-dip galvanizing. The coating amount of hot-dip zinc in this case may be appropriately determined in accordance with required corrosion resistance and is not particularly limited. However, the amount is generally 30 to 60 g/m$^2$ in steel sheets used for automobile structural members.

After the above hot-dip galvanizing is performed, the high strength steel sheet may be further processed by an alloying treatment, whenever desired, in which a hot-dip galvanizing layer is alloyed while it is held in a temperature range of 450 to 580° C. In this alloying treatment, when the treatment temperature becomes high, the Fe content in the coating layer is more than 15 mass percent, and it becomes difficult to ensure coating adhesion and formability. Hence, the treatment temperature is preferably set to 580° C. or less. On the other hand, when the alloying treatment temperature is less than 450° C., since the alloying is performed slowly, the productivity is decreased. Hence, the alloying treatment temperature is preferably set in the range of 450 to 580° C.

EXAMPLE

Example 1

After steel Nos. 1 to 26 having component compositions shown in Table 1 were each melted in a vacuum fusion furnace to form a small ingot, this ingot was then heated to 1,250° C. and held for 1 hour, followed by hot rolling, so that a hot-rolled steel sheet having a thickness of 3.5 mm was obtained. In this process, the finish rolling end temperature of the hot rolling was set to 890° C., cooling was performed after the rolling at an average cooling rate of 20° C./second, and a heat treatment was then performed at 600° C. for 1 hour which corresponded to a coiling temperature of 600° C. Next, after this hot-rolled steel sheet was processed by pickling and was then cold-rolled to a thickness of 1.5 mm, annealing was performed in a reducing gas (containing $N_2$ and 5 percent by volume of $H_2$) for this cold-rolled steel sheet under conditions shown in Table 2, so that a cold-rolled steel sheet (CR) was formed. In addition, after the annealing described above was performed, part of the cold-rolled steel sheet was immersed in a hot-dip galvanizing bath at a temperature of 470° C. for a hot-dip galvanizing treatment, followed by cooling to room temperature, to form a hot-dip galvanized steel sheet (GI), or after the above hot-dip galvanizing, the part of the cold-rolled steel sheet thus processed was further processed by an alloying treatment at 550° C. for 15 seconds to form a hot-dip galvannealed steel sheet (GA). The amount of the above hot-dip galvanizing was set to 60 g/m$^2$ per one surface.

The cold-rolled steel sheets (CR), the hot-dip galvanized steel sheets (GI), and the hot-dip galvannealed steel sheets (GA) thus obtained were subjected to the following tests.

Microstructure

After cross-sectional microstructures of the above three types of steel sheets in parallel to the rolling direction were observed using a SEM, and the photos of the microstructures were image-analyzed, from occupied areas of ferrite and pearlite, the area rates thereof were obtained and were regarded as the volume fractions. In addition, the volume fraction of retained austenite was measured by performing chemical polishing of the steel sheet to a plane at a depth corresponding to one fourth of the sheet thickness, followed by performing x-ray diffraction of this polished plane. The Mo—$K_\alpha$ line was used as an incident x-ray of the above x-ray diffraction, and diffraction x-ray intensities of the {111}, {2003, and {311} planes of the retained austenite phase with respect to those of the {110}, {200}, and 211} planes of the ferrite phase were obtained, so that the average value thereof was regarded as the volume fraction of the retained austenite phase. In addition, the balance of the total value of the volume fractions of ferrite, pearlite, and retained austenite was regarded, as the volume fraction of martensite.

Tensile Test

After JIS No. 5 tensile test pieces in accordance with JIS Z2201 were obtained from the above three types of steel sheets so that the tensile direction was along the rolling direction, a tensile test in accordance with JIS Z2241 was performed, so that the yield stress YP, the tensile strength TS, and elongation El were measured. In addition, from the above results, to evaluate the strength-ductility balance, the value of TS×El was obtained.

Phosphatability

After a phosphatability treatment was performed for the above cold-rolled annealed steel sheet using a commercially available phosphatability agent (Palbond PB-L3020 system manufactured by Nihon Parkerizing Co., Ltd.) at a bath temperature of 42° C. for a treatment time of 120 seconds, a phosphate film formed on the steel sheet surface was observed using a SEM, and the phosphatability were then evaluated based on the following criteria:

◎: Lack of hiding and irregularity are not observed on the phosphate film.

○: Lack of hiding is not observed on the phosphate film, but irregularity is observed to a certain extent.

Δ: Lack of hiding is observed on part of the phosphate film.

x: Lack of hiding is apparently observed on the phosphate film.

Zn Coatability

The surface of the hot-dip galvanized steel sheet (GI) and that of the hot-dip galvannealed steel sheet (GA) were observed by visual inspection and with a magnifier having a magnification of 10× and were then evaluated based on the following criteria:

○: Bare spot is not present (bare spot is not observed at all).

Δ: Bare spot is slightly present (a very small bare spot part observable by a magnifier having a magnification of 10× is present, but this problem can be solved by improvement in conditions, such as the temperature of a coating bath, or the temperature of a steel sheet when it is immersed in the coating bath).

x: Bare spot is present (bare spot is observed by visual inspection, and this problem cannot be solved by improvement in coating conditions).

Appearance Evaluation

The surface of the hot-dip galvannealed steel sheet (GA) was observed by visual inspection, and the generation of appearance irregularities caused by alloying delay was investigated. Subsequently, the evaluation was performed based on the following criteria:

○: No irregularities caused by alloying (good).

x: Irregularities caused by alloying (no good).

TABLE 1

| Steel | Chemical component (mass percent) | | | | | | | | | | | | | | | |
|---|---|---|---|---|---|---|---|---|---|---|---|---|---|---|---|---|
| No. | C | Si | Mn | P | S | Al | N | Cr | Mo | Ti | B | Nb | V | Cu | Ni | Remarks |
| 1 | 0.17 | 0.02 | 2.0 | 0.01 | 0.002 | 0.81 | 0.002 | — | 0.30 | 0.022 | 0.0012 | 0.031 | — | — | — | Invention steel |
| 2 | 0.11 | 0.01 | 2.8 | 0.01 | 0.002 | 1.41 | 0.001 | — | 0.15 | 0.032 | 0.0012 | — | — | — | — | Invention steel |
| 3 | 0.16 | 0.28 | 2.2 | 0.02 | 0.001 | 0.73 | 0.002 | — | 0.20 | 0.034 | 0.0009 | — | — | — | — | Invention steel |
| 4 | 0.13 | 0.25 | 2.5 | 0.02 | 0.002 | 0.65 | 0.002 | — | 0.10 | 0.012 | 0.0005 | 0.014 | 0.014 | — | 0.1 | Invention steel |
| 5 | 0.15 | 0.25 | 2.0 | 0.01 | 0.001 | 0.71 | 0.002 | 0.71 | — | 0.021 | 0.0010 | 0.023 | — | — | — | Invention steel |
| 6 | 0.15 | 0.26 | 2.0 | 0.01 | 0.001 | 0.70 | 0.002 | 1.05 | — | 0.024 | 0.0009 | — | — | — | — | Invention steel |
| 7 | 0.12 | 0.27 | 2.1 | 0.01 | 0.002 | 0.72 | 0.002 | — | 0.30 | 0022 | 0.0015 | — | — | — | — | Invention steel |
| 8 | 0.13 | 0.25 | 2.2 | 0.01 | 0.001 | 0.79 | 0.002 | 0.52 | — | 0.023 | 0.0012 | — | 0.052 | — | 0.06 | Invention steel |
| 9 | 0.15 | 0.24 | 2.9 | 0.02 | 0.002 | 0.75 | 0.002 | — | 0.10 | 0.021 | 0.0015 | 0.019 | — | — | — | Invention steel |
| 10 | 0.14 | 0.26 | 2.2 | 0.02 | 0.001 | 1.10 | 0.002 | 0.69 | 0.20 | 0.018 | 0.0014 | 0.032 | — | — | — | Invention steel |
| 11 | 0.16 | 0.26 | 2.2 | 0.01 | 0.001 | 1.07 | 0.003 | — | 0.20 | 0.011 | 0.0011 | 0.022 | — | — | — | Invention steel |
| 12 | 0.18 | 0.45 | 1.6 | 0.01 | 0.001 | 0.60 | 0.003 | 0.51 | 0.30 | 0.030 | 0.0017 | — | — | — | — | Invention steel |
| 13 | 0.13 | 0.45 | 2.2 | 0.01 | 0.001 | 1.21 | 0.004 | — | 0.15 | 0.022 | 0.0015 | — | — | — | — | Invention steel |
| 14 | 0.15 | 0.31 | 2.1 | 0.01 | 0.001 | 0.75 | 0.003 | 0.32 | — | 0.021 | 0.0012 | 0.019 | — | — | — | Invention steel |
| 15 | 0.14 | 0.01 | 1.8 | 0.02 | 0.002 | 0.50 | 0.003 | 0.07 | — | 0.030 | 0.0012 | — | — | — | — | Comparative steel |
| 16 | 0.12 | 0.01 | 1.4 | 0.02 | 0.002 | 0.52 | 0.002 | 0.52 | — | 0.019 | 0.0012 | — | — | 0.05 | 0.1 | Comparative steel |
| 17 | 0.13 | 0.02 | 3.1 | 0.01 | 0.003 | 1.51 | 0.002 | 0.62 | — | 0.030 | 0.0009 | 0.020 | — | — | — | Comparative steel |
| 18 | 0.14 | 0.21 | 2.1 | 0.01 | 0.001 | 0.03 | 0.003 | 0.49 | — | 0.024 | 0.0011 | — | — | — | — | Comparative steel |
| 19 | 0.14 | 0.52 | 2.1 | 0.01 | 0.001 | 0.03 | 0.003 | 1.23 | — | 0.020 | 0.0009 | — | — | — | — | Comparative steel |
| 20 | 0.15 | 0.25 | 1.8 | 0.01 | 0.002 | 0.35 | 0.002 | 0.72 | 0.04 | 0.021 | 0.0009 | 0.021 | — | — | — | Comparative steel |
| 21 | 0.15 | 0.24 | 1.9 | 0.02 | 0.002 | 0.92 | 0.003 | 0 | 0 | 0.019 | 0.0023 | 0.032 | — | — | — | Comparative steel |
| 22 | 0.15 | 0.25 | 2.1 | 0.01 | 0.002 | 1.55 | 0.003 | — | 0.15 | 0.024 | 0.0010 | — | 0.032 | — | — | Comparative steel |
| 23 | 0.15 | 0.25 | 1.8 | 0.01 | 0.001 | 0.71 | 0.002 | 1.82 | — | 0.021 | 0.0011 | — | — | — | — | Comparative steel |
| 24 | 0.15 | 0.25 | 1.8 | 0.01 | 0.001 | 0.71 | 0.003 | — | 2.08 | 0.023 | 0.0012 | — | — | — | — | Comparative steel |
| 25 | 0.13 | 1.40 | 1.9 | 0.01 | 0.001 | 0.70 | 0.003 | 0.71 | — | 0.022 | 0.0012 | — | — | — | 0.2 | Comparative steel |
| 26 | 0.15 | 1.03 | 2.1 | 0.01 | 0.002 | 0.69 | 0.002 | 0.73 | — | 0.023 | 0.0010 | — | — | — | — | Comparative steel |

TABLE 2

| | | | Annealing conditions | | | | | Microstructure of steel sheet | | | |
|---|---|---|---|---|---|---|---|---|---|---|---|
| Steel sheet No. | Steel No. | Product Type | Soaking temperature (° C.) | Soaking time (sec) | Average cooling rate (° C./s) | Cooling stop temperature (° C.) | Alloying temperature (° C.) | Martensite fraction (%) | Ferrite fraction (%) | Retained γ fraction (%) | Pearlite fraction (%) |
| 1A | 1 | GA | 910 | 180 | 15 | 470 | 550 | 46.5 | 52.3 | 1.2 | 0 |
| 1C | 1 | CR | 820 | 60 | 10 | 470 | — | 38.6 | 60.3 | 1.1 | 0 |
| 2A | 2 | GA | 750 | 90 | 15 | 470 | 550 | 32.1 | 65.8 | 2.1 | 0 |
| 3A | 3 | GA | 850 | 210 | 20 | 470 | 550 | 52.0 | 46.4 | 1.6 | 0 |
| 4A | 4 | GA | 890 | 210 | 7 | 470 | 550 | 40.4 | 58.3 | 1.3 | 0 |
| 5I | 5 | GI | 820 | 60 | 10 | 470 | — | 35.3 | 63.2 | 1.5 | 0 |
| 6A | 6 | GA | 840 | 60 | 15 | 470 | 550 | 40.1 | 58.7 | 1.2 | 0 |
| 6C | 6 | CR | 840 | 60 | 15 | 470 | — | 40.3 | 58.3 | 1.4 | 0 |
| 7A | 7 | GA | 840 | 60 | 15 | 470 | 550 | 28.9 | 69.1 | 2.0 | 0 |
| 7C | 7 | CR | 820 | 60 | 10 | 470 | — | 28.6 | 69.3 | 2.1 | 0 |
| 8A | 8 | GA | 850 | 120 | 15 | 470 | 550 | 35.0 | 62.1 | 2.9 | 0 |
| 9A | 9 | GA | 840 | 90 | 25 | 470 | 550 | 33.7 | 64.9 | 1.4 | 0 |
| 10A | 10 | GA | 850 | 150 | 10 | 470 | 550 | 45.0 | 53.7 | 1.3 | 0 |
| 11A | 11 | GA | 800 | 60 | 15 | 470 | 550 | 65.1 | 32.7 | 2.2 | 0 |

TABLE 2-continued

| | | | | | | | | | | | |
|---|---|---|---|---|---|---|---|---|---|---|---|
| 11C | 11 | CR | 820 | 60 | 10 | 470 | — | 63.6 | 34.6 | 1.8 | 0 |
| 12A | 12 | GA | 860 | 270 | 30 | 470 | 550 | 51.2 | 47.0 | 1.8 | 0 |
| 13I | 13 | GI | 820 | 30 | 2 | 470 | — | 5.4 | 72.5 | 0 | 22.1 |
| 14A | 14 | GA | 880 | 60 | 10 | 470 | 550 | 35.2 | 62.5 | 2.3 | 0 |
| 14C | 14 | CR | 820 | 60 | 10 | 470 | — | 34.9 | 63.7 | 1.4 | 0 |
| 15A | 15 | GA | 840 | 180 | 25 | 470 | 550 | 27.0 | 67.8 | 5.2 | 0 |
| 16A | 16 | GA | 850 | 150 | 7 | 470 | 550 | 19.6 | 77.2 | 3.2 | 0 |
| 17C | 17 | CR | 850 | 90 | 15 | 470 | — | 59.8 | 38.4 | 1.8 | 0 |
| 18I | 18 | GI | 820 | 60 | 10 | 470 | — | 37.5 | 58.2 | 4.3 | 0 |
| 19A | 19 | GA | 820 | 60 | 15 | 470 | 550 | 55.9 | 42.3 | 1.8 | 0 |
| 20A | 20 | GA | 850 | 60 | 10 | 470 | 550 | 36.4 | 62.4 | 1.2 | 0 |
| 21A | 21 | GA | 860 | 120 | 10 | 470 | 550 | 21.6 | 70.6 | 7.8 | 0 |
| 22C | 22 | CR | 830 | 150 | 10 | 470 | — | 34.9 | 63.0 | 2.1 | 0 |
| 23A | 23 | GA | 840 | 60 | 15 | 470 | 550 | 40.3 | 58.0 | 1.7 | 0 |
| 24C | 24 | CR | 840 | 90 | 15 | 470 | — | 75.2 | 23.7 | 1.1 | 0 |
| 25A | 25 | GA | 830 | 60 | 20 | 470 | 550 | 34.5 | 62.4 | 3.1 | 0 |
| 26I | 26 | GI | 830 | 90 | 7 | 520 | — | 32.3 | 57.5 | 10.2 | 0 |

| Steel | Mechanical properties | | | | Zn | Appearance | | |
|---|---|---|---|---|---|---|---|---|
| sheet No. | YP (MPa) | TS (MPa) | EI (%) | TS × EI (MPa %) | coat-ability | after alloying treatment | Phosphat-ability | Remarks |
| 1A | 804 | 1,198 | 11.8 | 14,136 | ○ | ○ | — | Comparative Example |
| 1C | 592 | 1,058 | 19.2 | 20,314 | — | — | ○ | Invention Example |
| 2A | 724 | 1,067 | 13.2 | 14,084 | ○ | ○ | — | Comparative Example |
| 3A | 834 | 1,241 | 14.8 | 18,367 | ○ | ○ | — | Invention Example |
| 4A | 621 | 1,112 | 15.5 | 17,236 | ○ | ○ | — | Invention Example |
| 5I | 654 | 1,047 | 18.5 | 19,370 | ○ | — | — | Invention Example |
| 6A | 635 | 1,152 | 16.7 | 19,238 | ○ | ○ | — | Invention Example |
| 6C | 649 | 1,156 | 16.9 | 19,536 | — | — | ◎ | Invention Example |
| 7A | 578 | 1,050 | 19.2 | 20,160 | ○ | ○ | — | Invention Example |
| 7C | 598 | 1,046 | 19.3 | 20,188 | — | — | ○ | Invention Example |
| 8A | 586 | 1,023 | 18.7 | 19,130 | ○ | ○ | — | Invention Example |
| 9A | 624 | 1,014 | 19.1 | 19,367 | ○ | ○ | — | Invention Example |
| 10A | 681 | 1,183 | 16.9 | 19,993 | ○ | ○ | — | Invention Example |
| 11A | 867 | 1,274 | 14.2 | 18,091 | ○ | ○ | — | Invention Example |
| 11C | 845 | 1,267 | 14.6 | 18,498 | — | — | ◎ | Invention Example |
| 12A | 824 | 1,218 | 15.4 | 18,757 | ○ | ○ | — | Invention Example |
| 13I | 430 | 648 | 24.2 | 15,682 | ○ | — | — | Comparative Example |
| 14A | 562 | 967 | 17.1 | 16,536 | ○ | ○ | — | Invention Example |
| 14C | 638 | 1,025 | 17.3 | 17,733 | — | — | ◎ | Invention Example |
| 15A | 541 | 971 | 15.9 | 15,439 | ○ | ○ | — | Comparative Example |
| 16A | 421 | 774 | 20.6 | 15,944 | ○ | ○ | — | Comparative Example |
| 17C | 922 | 1,292 | 10.8 | 13,954 | — | — | Δ | Comparative Example |
| 18I | 624 | 1,054 | 15.1 | 15,915 | ○ | — | — | Comparative Example |
| 19A | 984 | 1,321 | 10.9 | 14,399 | Δ | ○ | — | Comparative Example |
| 20A | 634 | 1,023 | 15.5 | 15,857 | ○ | ○ | — | Comparative Example |
| 21A | 492 | 859 | 20.4 | 17,524 | ○ | X | — | Comparative Example |
| 22C | 687 | 1,026 | 15.2 | 15,595 | — | — | X | Comparative Example |
| 23A | 642 | 1,164 | 13.8 | 16,063 | X | ○ | — | Comparative Example |
| 24C | 1,012 | 1,366 | 10.2 | 13,933 | — | — | X | Comparative Example |
| 25A | 649 | 1,003 | 17.6 | 17,653 | X | X | — | Comparative Example |
| 26I | 628 | 1,042 | 18.4 | 19,173 | X | — | — | Comparative Example |

The results of the above evaluation tests are also shown in Table 2.

From Table 2, it was found that all the steel sheets manufactured using our steels and under our manufacturing conditions had a good strength-ductility balance since the tensile strength TS was 950 MPa or more and the TS×El was 16,000 MPa·% or more, and were also superior in terms of the phosphatability, Zn coatability, and alloying treatment properties.

On the other hand, the steel sheets which did not satisfy our component compositions and manufacturing conditions were each inferior in at least one of the properties described above. For example, in steel sheet No. 1A in which the soaking temperature was excessively high although the component composition of steel was satisfied, the microstructure was coarsened, and the ductility was degraded. Hence, the strength-ductility balance was degraded. In addition, in steel sheet No. 2A, since the soaking temperature was excessively low, the recrystallization was not sufficiently performed and, hence, the ductility was degraded. In addition, in steel sheet No. 13I, since the cooling rate from the soaking temperature was too slow, pearlite was unfavorably generated to a level of 22.1%, and the fraction of martensite was decreased. Hence, the tensile strength was less than 950 MPa.

In addition, all steel sheet Nos. 15A, 16A, 17C, 18I, 19A, 20A, 22C, and 24C had a TS×El of less 16,000 MPa·% and were inferior in terms of the strength-ductility balance. In addition, in steel sheet No. 21A, although the TS×El was 16,000 MPa·% more, the tensile strength was less than 950 MPa. Furthermore, in steel sheet Nos. 25A and 261 having a high Si content which were not our steels, and steel sheet No. 23A having a high Cr content which was not our steel, although the TS×El was 16,000 MPa·% more, because of the presence of oxides formed on surfaces of the steel sheet, the Zn coatability and the alloying treatment properties were degraded.

Example 2

Hot-dip galvannealed steel sheets (GA) were each formed by the steps of forming a cold-rolled steel sheet from each of ingot Nos. 2, 5, 18, and 21 shown in Table 1 under the conditions shown in Example 1, performing annealing under fixed conditions except that the soaking temperature was changed to three levels of 780, 820, and 860° C. as shown in Table 3, and then performing hot-dip galvanizing, followed by performing an alloying treatment.

In a manner similar to that in Example 1, the microstructures and the mechanical properties of the above hot-dip galvannealed steel sheets were investigated, and the results thereof are also shown in Table 3.

TABLE 3

| | | | Annealing conditions | | | | | Microstructure of steel sheet | |
|---|---|---|---|---|---|---|---|---|---|
| Steel sheet No. | Steel No. | Product Type | Soaking temperature (° C.) | Soaking time (sec) | Average cooling rate (° C./s) | Cooling stop temperature (° C.) | Alloying temperature (° C.) | Martensite fraction (%) | Ferrite fraction (%) |
| 2a | 2 | GA | 780 | 60 | 10 | 470 | 550 | 35.2 | 63.0 |
| 2b | 2 | GA | 820 | 60 | 10 | 470 | 550 | 34.9 | 63.5 |
| 2c | 2 | GA | 860 | 60 | 10 | 470 | 550 | 34.6 | 63.5 |
| 5a | 5 | GA | 780 | 60 | 10 | 470 | 550 | 37.2 | 60.5 |
| 5b | 5 | GA | 820 | 60 | 10 | 470 | 550 | 35.3 | 63.2 |
| 5c | 5 | GA | 860 | 60 | 10 | 470 | 550 | 35.5 | 62.4 |
| 18a | 18 | GA | 780 | 60 | 10 | 470 | 550 | 44.1 | 53.6 |
| 18b | 18 | GA | 820 | 60 | 10 | 470 | 550 | 37.5 | 58.2 |
| 18c | 18 | GA | 860 | 60 | 10 | 470 | 550 | 32.6 | 64.3 |
| 21a | 21 | GA | 780 | 60 | 10 | 470 | 550 | 35.0 | 58.2 |
| 21b | 21 | GA | 820 | 60 | 10 | 470 | 550 | 29.2 | 64.9 |
| 21c | 21 | GA | 860 | 60 | 10 | 470 | 550 | 24.2 | 70.2 |

| | Microstructure of steel sheet | | Mechanical properties | | | | | |
|---|---|---|---|---|---|---|---|---|
| Steel sheet No. | Retained γ fraction (%) | Pearlite fraction (%) | YP (MPa) | TS (MPa) | EI (%) | TS × EI (MPa %) | ΔTS (MPa) | Remarks |
| 2a | 1.8 | 0 | 602 | 1,058 | 17.4 | 18,409 | 37 | Invention Example |
| 2b | 1.6 | 0 | 572 | 1,023 | 17.8 | 18,209 | | Invention Example |
| 2c | 1.9 | 0 | 569 | 1,021 | 17.9 | 18,276 | | Invention Example |
| 5a | 2.3 | 0 | 674 | 1,065 | 17.8 | 18,957 | 20 | Invention Example |
| 5b | 1.5 | 0 | 654 | 1,047 | 18.5 | 19,370 | | Invention Example |
| 5c | 2.1 | 0 | 648 | 1,045 | 18.6 | 19,437 | | Invention Example |
| 18a | 2.3 | 0 | 724 | 1,124 | 12.4 | 13,938 | 138 | Comparative Example |
| 18b | 4.3 | 0 | 618 | 1,038 | 15.0 | 15,570 | | Comparative Example |
| 18c | 3.1 | 0 | 589 | 986 | 16.1 | 15,875 | | Comparative Example |
| 21a | 6.8 | 0 | 689 | 1,011 | 14.8 | 14,963 | 157 | Comparative Example |
| 21b | 5.9 | 0 | 569 | 904 | 18.2 | 18,453 | | Comparative Example |
| 21c | 5.6 | 0 | 492 | 854 | 20.7 | 17,678 | | Comparative Example |

From Table 3, in the steel sheets obtained from steel Nos. 18 and 21 which were not our steels, the variation ΔTS in tensile strength obtained when the soaking temperature was changed in the range of 780 to 860° C. was apparently larger than 100 MPa. However, in the steel sheets obtained from steel Nos. 2 and 5 which were our steels, the variation in tensile strength was 100 MPa or less. Accordingly, it was found that our steel sheets were superior in manufacturing stability.

INDUSTRIAL APPLICABILITY

Since having superior ductility in spite of a high strength, our high strength steel sheet is not only applied to automobile components but is also preferably used in applications for home electric appliances and building/construction to which conventional materials have not been easily applied since excellent formability has been required.

The invention claimed is:

1. A high strength steel sheet comprising: a component composition which includes 0.05 to 0.20 mass percent of C, 0.5 mass percent or less of Si, 1.5 to 3.0 mass percent of Mn, 0.06 mass percent or less of P, 0.01 mass percent or less of S, 0.3 to 1.5 mass percent of Al, 0.02 mass percent or less of N, 0.01 to 0.1 mass percent of Ti, and 0.0005 to 0.0030 mass percent of B; 0.4 to 1.5 mass percent of Cr; and the balance being Fe and inevitable impurities, wherein the high strength steel sheet is composed of a microstructure including 20% to 70% ferrite and 20% or more of martensite in volume fraction, has a tensile strength of 950 MPa or more, and has a strength-ductility balance of more than 18,000 (MPa. %); and wherein said high strength steel sheet is manufactured by a process comprising hot-rolling a slab comprising said component composition; cold-rolling the resulting hot-rolled sheet; annealing the resulting cold-rolled sheet at a temperature of 780 to 900° C for 300 seconds or less; and cooling the sheet to a temperature of 500° C or less at an average cooling rate of 7 to 30° C/second.

2. The high strength steel sheet according to claim 1, further comprising at least one of 0.01 to 0.1 mass percent of Nb and 0.01 to 0.12 mass percent of V.

3. The high strength steel sheet according to claim 1, further comprising at least one of Cu and Ni in a total content of 0.01 to 4.0 mass percent.

4. The high strength steel sheet according to claim 2, further comprising at least one of Cu and Ni in a total content of 0.01 to 4.0 mass percent.

5. The high strength steel sheet according to claim 1, wherein the microstructure further includes less than 10% of retained austenite in volume fraction.

6. The high strength steel sheet according to claim 1, wherein the steel sheet is provided with a hot-dip galvanizing layer thereon.

7. The high strength steel sheet according to claim 2, wherein the steel sheet is provided with a hot-dip galvanizing layer thereon.

8. The high strength steel sheet according to claim 3, wherein the steel sheet is provided with a hot-dip galvanizing layer thereon.

9. The high strength steel sheet according to claim 4, wherein the steel sheet is provided with a hot-dip galvanizing layer thereon.

10. The high strength steel sheet according to claim 1, wherein the steel sheet is provided with an hot-dip galvannealed layer thereon.

* * * * *